US009032571B2

(12) United States Patent
Rancourt et al.

(10) Patent No.: US 9,032,571 B2
(45) Date of Patent: May 19, 2015

(54) CUSHIONING STRUCTURES FOR BODY PARTS

(75) Inventors: Denis Rancourt, Rock Forest (CA); Jean-Luc Lessard, Sherbrooke (CA); Marc Denninger, Sherbrooke (CA); Nicolas Huppe, Sherbrooke (CA); Paule Cousineau-Pelletier, Sherbrooke (CA)

(73) Assignee: Nubatech Inc., Nicolet, Québec (CA)

( * ) Notice: Subject to any disclaimer, the term of this patent is extended or adjusted under 35 U.S.C. 154(b) by 1232 days.

(21) Appl. No.: 12/299,770

(22) PCT Filed: May 4, 2007

(86) PCT No.: PCT/CA2007/000778

§ 371 (c)(1), (2), (4) Date: Mar. 6, 2009

(87) PCT Pub. No.: WO2007/128113

PCT Pub. Date: Nov. 15, 2007

(65) Prior Publication Data

US 2010/0005594 A1 Jan. 14, 2010

Related U.S. Application Data

(60) Provisional application No. 60/797,652, filed on May 5, 2006.

(51) Int. Cl.

| | |
|---|---|
| ***A47C 20/02*** | (2006.01) |
| ***B68G 5/00*** | (2006.01) |
| ***A47C 17/00*** | (2006.01) |
| ***A47C 27/14*** | (2006.01) |
| ***A47C 23/00*** | (2006.01) |

(Continued)

(52) U.S. Cl.

CPC ..... *A47C 27/146* (2013.01); *A47C 23/002* (2013.01); *A47C 27/144* (2013.01); *A47C 27/148* (2013.01); *A47C 27/15* (2013.01); *A47C 27/20* (2013.01)

(58) Field of Classification Search

USPC ..... 5/464, 481, 724, 727, 652, 655, 420, 5/655.9, 740

See application file for complete search history.

(56) References Cited

U.S. PATENT DOCUMENTS 1,980,445 A * 11/1934 Sherover ..... 5/724
3,885,257 A * 5/1975 Rogers ..... 5/730

(Continued)

FOREIGN PATENT DOCUMENTS

| | | | |
|---|---|---|---|
| CA | 22255616 | A1 | 11/1997 |
| CA | 2533009 | A1 | 2/2005 |
| WO | 97/45038 | A1 | 12/1997 |

*Primary Examiner* — Peter M Cuomo
*Assistant Examiner* — Brittany Wilson
(74) *Attorney, Agent, or Firm* — Equinox IP; Fronz Bonsang

(57) ABSTRACT

The invention discloses a body cushioning pad, a body contact mat and a multi-layered cushioning structure composed of the body cushioning pad and the body contact mat. The cushioning pad consists of a plurality of foam blocks, each provided with an internal cavity having a predetermined size and shape to control the firmness of the block and means for maintaining the foam blocks as a unit. The body contact mat is a bi-dimensional latticed structure of spaced-apart studs made of a compressible material linked together by flexible linking elements. The multi-layered cushioning structure comprises both the cushioning pad and the body contact mat, and a wrapper to wrap the cushioning pad and the contact mat together.

13 Claims, 14 Drawing Sheets

(51) Int. Cl.
*A47C 27/15* (2006.01)
*A47C 27/20* (2006.01)

(56) References Cited

U.S. PATENT DOCUMENTS

| | | | | |
|---|---|---|---|---|
| 4,524,473 | A | | 6/1985 | Fanti |
| 4,809,374 | A | | 3/1989 | Saviez |
| 4,847,933 | A | | 7/1989 | Bedford |
| 4,980,940 | A | | 1/1991 | Isshiki |
| 5,025,519 | A | | 6/1991 | Spann |
| 5,083,335 | A | | 1/1992 | Krouskop |
| 5,353,455 | A | * | 10/1994 | Loving et al. ..... 5/730 |
| 5,558,314 | A | | 9/1996 | Weinstein |
| 5,850,648 | A | * | 12/1998 | Morson ..... 5/724 |
| 6,284,346 | B1 | * | 9/2001 | Sheridan ..... 428/156 |
| 6,637,053 | B1 | | 10/2003 | DiNapoli |
| 6,865,759 | B2 | | 3/2005 | Pearce |
| 7,805,791 | B2 | * | 10/2010 | Malzl ..... 5/727 |
| 2002/0078509 | A1 | | 6/2002 | Williams |
| 2004/0158927 | A1 | * | 8/2004 | Soltani et al. ..... 5/689 |
| 2004/0237206 | A1 | | 12/2004 | Webster |
| 2006/0272098 | A1 | | 12/2006 | Hochschild |
| 2007/0186349 | A1 | * | 8/2007 | Lipman et al. ..... 5/713 |

* cited by examiner

CUSHIONING STRUCTURES FOR BODY PARTS

CROSS-REFERENCE TO RELATED APPLICATIONS

This application claims priority of International Application PCT/CA2007/000778 filed on May 4, 2007, claiming the priority of U.S. Provisional Patent Application No. 60/797,652 filed May 5, 2006, the contents of each application are incorporated by reference herein in their entirety.

FIELD OF THE INVENTION

The present invention relates generally to cushioning structures such as mattresses, chairs, bicycle seats, benches, couches, handles, shoulder straps, bandages, impact protection pads, helmet cushioning etc. used for reducing the pressure exerted upon a body (animal or human) in contact with the cushioning structure. More particularly, the invention concerns a body cushioning pad, a body contact mat and a multi-layered pressure-reducing structure composed of the body cushioning pad and the body contact mat.

BACKGROUND OF THE INVENTION

Cushioning structures or elements for reducing the pressure exerted upon a body may be used as mattresses, chairs, bicycle seats, benches, couches, handles, shoulder straps, bandages, impact protection pads, helmet cushioning, and the like are well-know in the art.

One goal usually in the manufacture of cushioning structures is to produce a structure capable of optimally dispersing the pressure without peak pressure points. This is even truer in the manufacture of cushioning structure, such as mattresses, devised to be used in hospitals. Another goal usually in that field is to manufacture a product that has good ventilation, and for certain cases massage effects.

With regards to cushioning structures, U.S. Pat. No. 5,353,455 (LOVING ET AL.) teaches a padding body that has flexible grid member with apertures formed in it. The apertures are defined by bordering sections of the grid member. The padding body includes individual modular elements with each modular element being resilient and each modular element having an intermediate section and an upper protuberance extending upwardly off from the intermediate section. The individual modular elements have a peripheral slit or recess formed in the intermediate section. Each of the individual modular elements is releasably fixed within a respective one of the apertures formed in the grid. One embodiment of the padding body includes a frame structure formed entirely of foam material.

Also known is the foam body described by U.S. Pat. No. 4,524,473 (FANTI). The foam material body described therein is for a bed, particularly a mattress, it has a single body part with a plurality of channels therein which extend straight and parallel to one another. These channels extend in direction transverse to the direction of elongation of the foam body over the whole transverse extension of the core.

U.S. Pat. No. 5,025,519 teaches a polyurethane foam mattress overlay that has several sections defined in a relatively flat support surface thereof. The sections are longitudinally disposed so as to correspond with different parts of a user's body. Each such section has predetermined support characteristics which are selected in relationship with such characteristics for the other sections so as to define systematized support. Specific numerical ranges and interrelationships for such sections are disclosed. A plurality of projections is formed in each surface section. In general, the cross-sectional area of such projections at the overlay support surface or at a given depth therefrom is the same within each section, but differs from one section to another. Separation distances between such projections may also vary with the respective sections. In such manner, tailored support characteristics in respective sections provide engineered support for all parts of a user's body.

Other cushioning structures known in the prior art are described in patent application US 2004/0237206 (WEBSTER ET AL.) concerning a dual-air ventilation pad, U.S. Pat. No. 5,850,648 (MORSON) concerning a ventilated mattress with semi-spherical projections, U.S. Pat. No. 4,980,940 (ISSHIKI) teaching a core material for a bed comprising a supporting base with a multiplicity of vertical cut-outs therein, and U.S. Pat. No. 5,083,335 (KROUSKOP, ET AL.) describing a foam mattress support having an intermediate layer with a plurality of ribs, themselves defining a cross-sectional area.

Also known in the art are pneumatic or elastomeric structures for distributing the pressure which present a plurality of studs for distributing the pressure exerted on it by a body. Examples of those are given in U.S. Pat. No. 6,865,759 (PEARCE); U.S. Pat. No. 4,847,933 (BEDFORD).

Although many efforts have been made in the past to produce body cushioning structures with better or optimized support for all parts of a supported body, there is room for improvements in that field.

SUMMARY OF THE INVENTION

An object of the present invention is to provide a structure that satisfies the above-mentioned need.

In accordance with one aspect of the invention, that object is achieved with a body cushioning pad comprising a plurality of foam blocks, each being provided with an internal cavity having a predetermined size and shape chosen to control the firmness of the block; and means for maintaining the plurality of foam blocks as a unit so as to form the cushioning pad.

As explained in further details further below in the detailed description of the drawings, the cavity confers many advantages to the foam blocks. One role of the cavity is to conform the body cushioning pad to the shape of the body. Typically, the compression curve between two planes of a full foam block is divided into three zones. The stiffness (slope of the force-displacement curve) is steeper at the beginning, flattening for a mid-compression over a certain distance, and becomes stiffer again at higher compression levels. The flat portion (zone of constant pressure) allows the cushioning surface to adapt to the body shape at constant pressure, thereby, ensuring maximum contact surface with the body and avoiding peak pressure points. The cavity enables the modification of the "zone of constant pressure". Thus, it is possible to modulate the levels of constraint to be exerted on the different parts of the body.

In accordance with another aspect of the invention, the object aforesaid is also achieved with a body contact mat comprising a bi-dimensional latticed structure of spaced-apart studs made of a compressible material linked together by flexible linking elements.

By latticed-structure, it is meant an open framework allowing air to circulate therethough.

The contact mat allows the distribution of the pressure exerted by the weight of the body on a desired percentage of the surface of the body. Since the surface of the body is in direct or indirect contact with the studs, the blood circulation between the points of contact is facilitated.

The present invention also provides a multi-layered cushioning structure comprising a body cushioning pad as described above; a body contact mat as described above, and a wrapper to wrap the cushioning pad The objects, advantages and other features of the present invention will become more apparent upon reading of the following non-restrictive description of preferred embodiments thereof, given for the purpose of exemplification only, with reference to the accompanying drawings.

BRIEF DESCRIPTION OF THE DRAWINGS

These and other objects and advantages of the invention will become apparent upon reading the detailed description and upon referring to the drawings in which:

FIG. 3A is a perspective view of the block. FIG. 3B is a top view and FIG. 3C is a cross-sectional view of the foam block along line A-A of FIG. 3B. The height "a" of the cavity, the width "b" of the cavity and the distance "p" are indicated schematically.

While the invention will be described in conjunction with example embodiments, it will be understood that it is not intended to limit the scope of the invention to such embodiments. On the contrary, it is intended to cover all alternatives, modifications and equivalents as may be included as defined by the appended claims.

DETAILED DESCRIPTION OF THE DRAWINGS

In the following description, the same numerical references refer to similar elements. The embodiments shown in the figures are preferred, and are namely used for exemplification purposes only.

As aforesaid, although the body cushioning pad, the body contact mat and the multi-layered cushioning structure according to the present invention were primarily designed for use as a mattress, it may be used as another type of cushioning structures, as apparent to a person skilled in the art. For this reason, expressions such as "cushioning structure", "cushion", "mattress", "mattress assembly", "multi-layered cushioning structure", etc., as used herein should not be taken as to limit the scope of the present invention and includes all other kinds of mattresses, cushions and/or cushioning structures and/or items with which the present invention could be used and may be useful. In other words, although the present invention is primarily designed to be used as a mattress, it could also be used as a cushioning structure for other objects, e.g. such as chairs, bicycle seats, benches, couches, handles, shoulder straps, bandages, impact protection pads, helmet cushioning, to name a few, as also apparent to a person skilled in the art. Thus, as aforesaid, expressions such as "cushion" or "mattress", etc. should not be taken as to limit the scope of the present invention and includes all other persons or objects with which the present invention could be used.

Figure 1A:
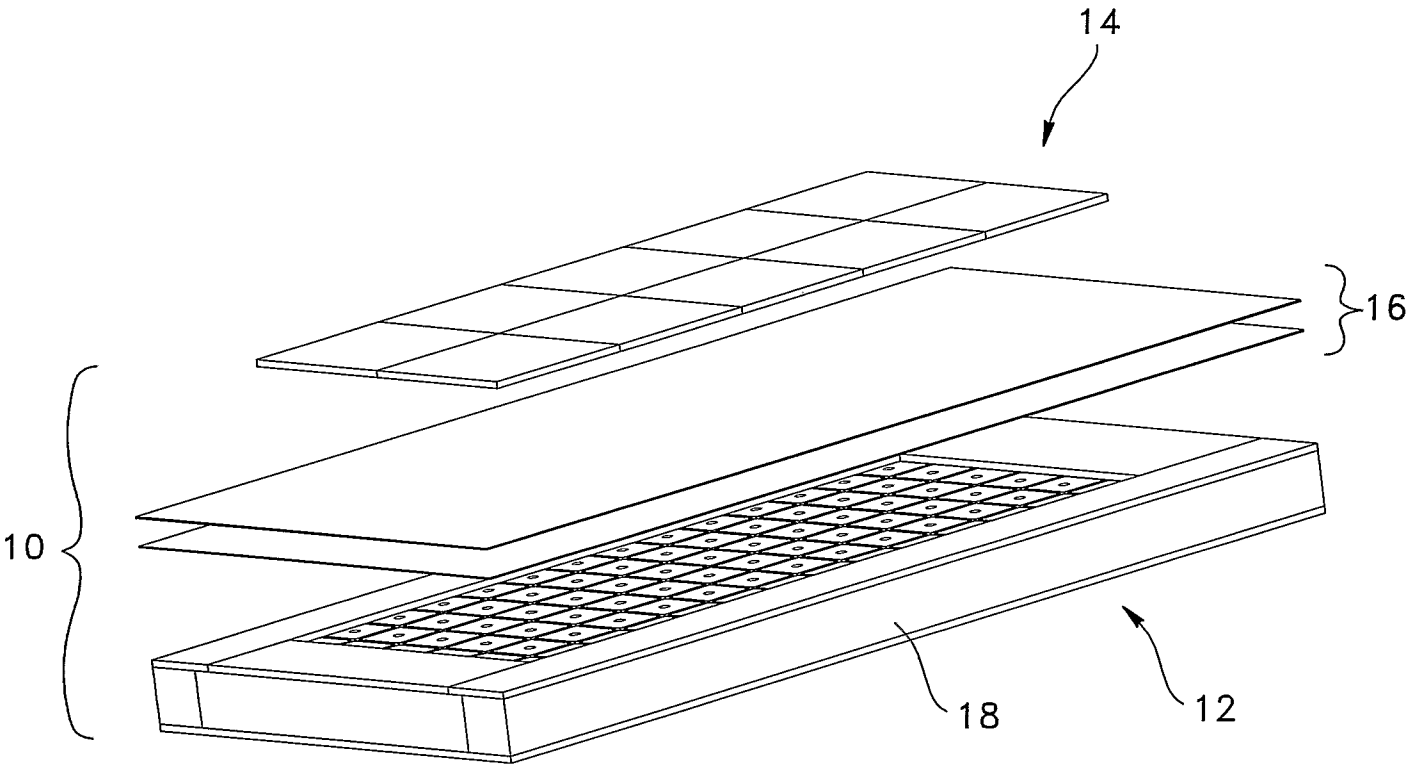
FIG. 1A is an exploded perspective view of a multi-layered mattress including a body cushioning pad and a body contact mat according to a preferred embodiment of the invention.
Figure 1B:
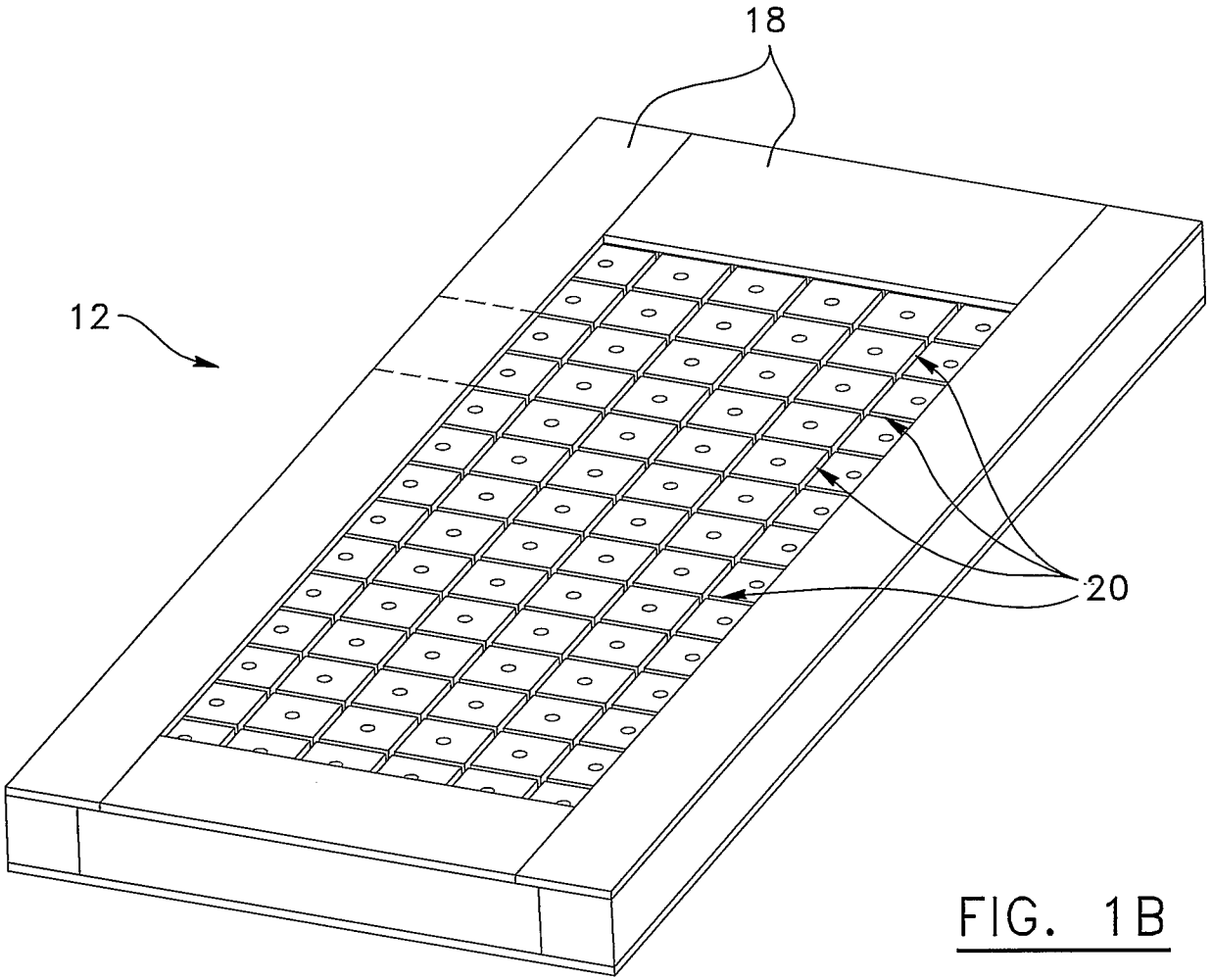
FIG. 1B is a perspective view of the body cushioning pad of FIG. 1A.

Now referring to FIGS. 1A and 1B, the multilayered mattress 10 comprises a body cushioning pad 12, a body contact mat 14 topping the cushioning pad 12 and, optionally, an antifriction fabric 16 inserted between the cushioning pad and the contact mat and/or directly over the contact mat. Although not illustrated, the mattress preferably comprises a wrapper or cover made of washable and/or flexible textile, fabric or plastic to wrap the cushioning pad 12 and the contact mat 14 together and to keep the patient body from being in contact with the bed layer and to ensure sanitary and flammability requirements. Also not illustrated, another embodiment of the invention may include an anti-friction fabric to be inserted between the cover and the body contact mat or positioned over the body contact mat 14. These anti-friction fabrics 16 may be made out of flame-retardant and/or lycra-type material. The end product can have both a lycra-type material underneath a flame-retardant material, as shown in FIG. 1.

As shown in FIGS. 1A and 1B, the body cushioning pad 12 presents a base 18 made out of lateral bumpers (also referred as framing elements) that surround an array of a plurality of adjacent foam blocks 20 filling a central depression. The firmness of the foam preferably ranges between Q21 and Q65 and the density of the foam preferably ranges from 1 lbs/ft$^3$ to 3 lbs/ft$^3$. The foam is of the open-cell type. The length of the edges of the blocks may vary between 2 and 6 inches and blocks are typically separated by a minimum of ¼inch spaces to allow interference-free bulging of adjacent blocks when compressed. For different applications such as a shoulder strap, the length of the edges of the blocks may vary between ¼ and 1 inch while the spaces between blocks may be 1/16 inch.

Figure 3A:
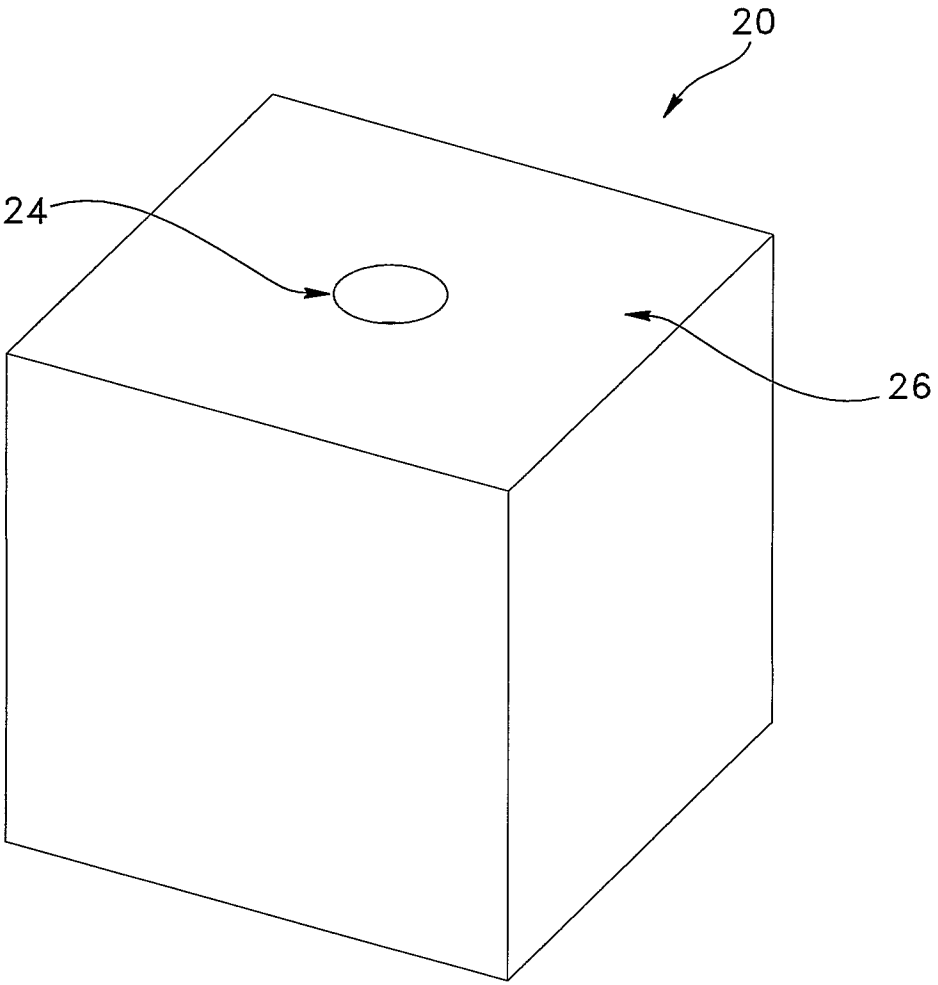
FIGS. 3A to 3C are different views of one of the foam blocks of the body cushioning pad of FIG. 1A.
Figure 3B:
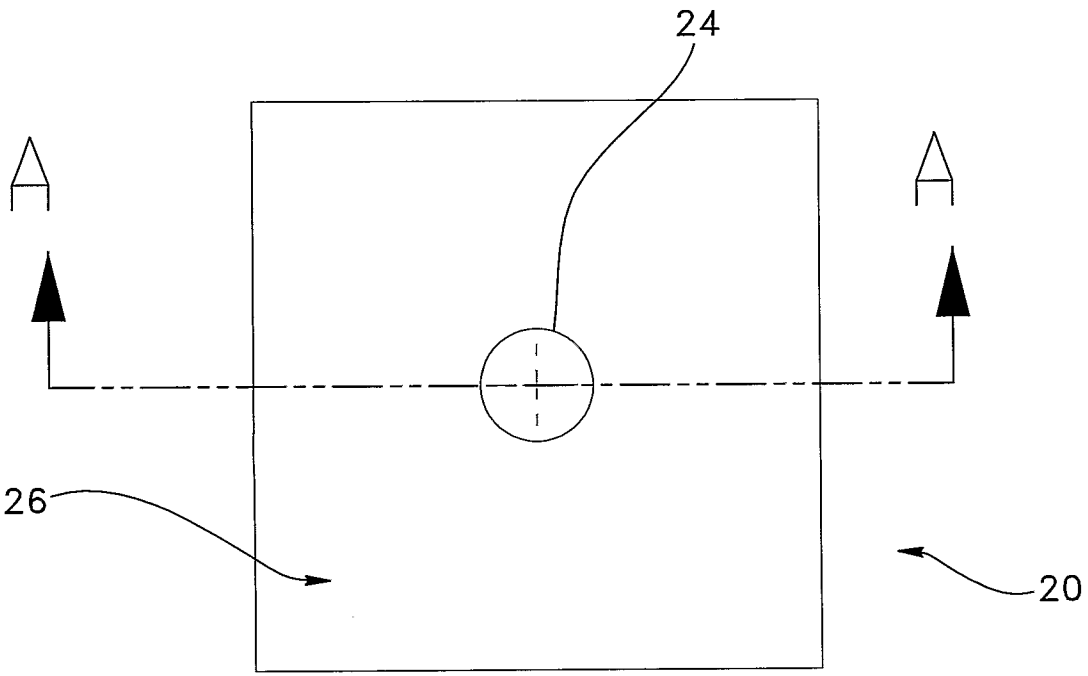
Figure 3C:
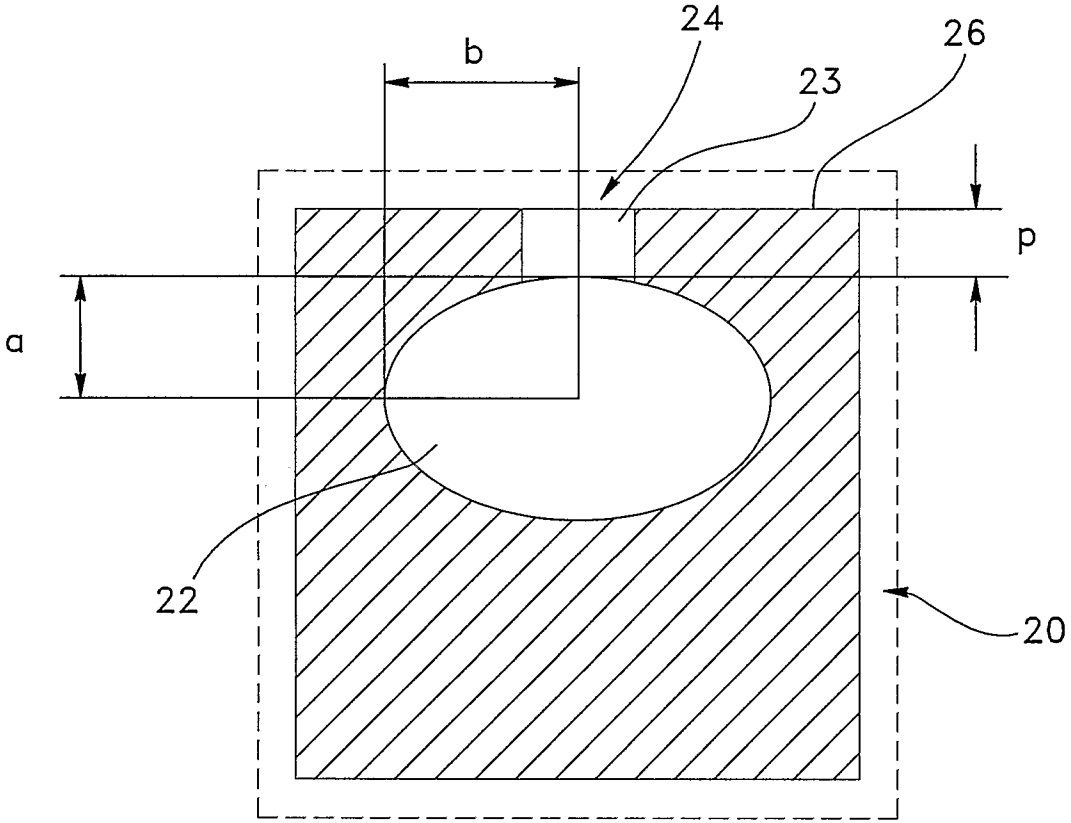

As better shown on FIG. 3, each block 20 of generally parallelepiped shape is provided with an internal closed cavity 22 in an upper portion thereof. The blocks have been emptied through an aperture 24 in an upper surface 26 thereof using hot-wire cutting, casting or machining with a cutter. The cutting pattern of the cavity is defined by the surface zone of the body cushioning pad 12, according to the desired characteristics to be attributed. The cavity 22 is located in an upper portion of the block, i.e., on the side of the zone of contact with the body. The cavity 22 may be of polygonal section form with n sides (n>2) (polyhedral form), spherical or ellipsoidal and is described by a height "a" and a width "b". Preferably, each foam block 20 comprises an internal canal 23 connecting the internal cavity 22 with a top surface of the block 20. The canal 23 which forms a bottleneck of a length "p" is created by the means for making a cavity and represents the distance between the aperture 24 on the surface of the block 26 (the point of entry of the means for creating a cavity) and the point of the body of the cavity 22 which is closest to the superior surface of the block 20.

Preferably, the volume of the cavity represents at least 3% of the total volume of the foam block 20. More preferably, it ranges from 3 to 30% of the total volume of the foam block 20.

Figure 4:
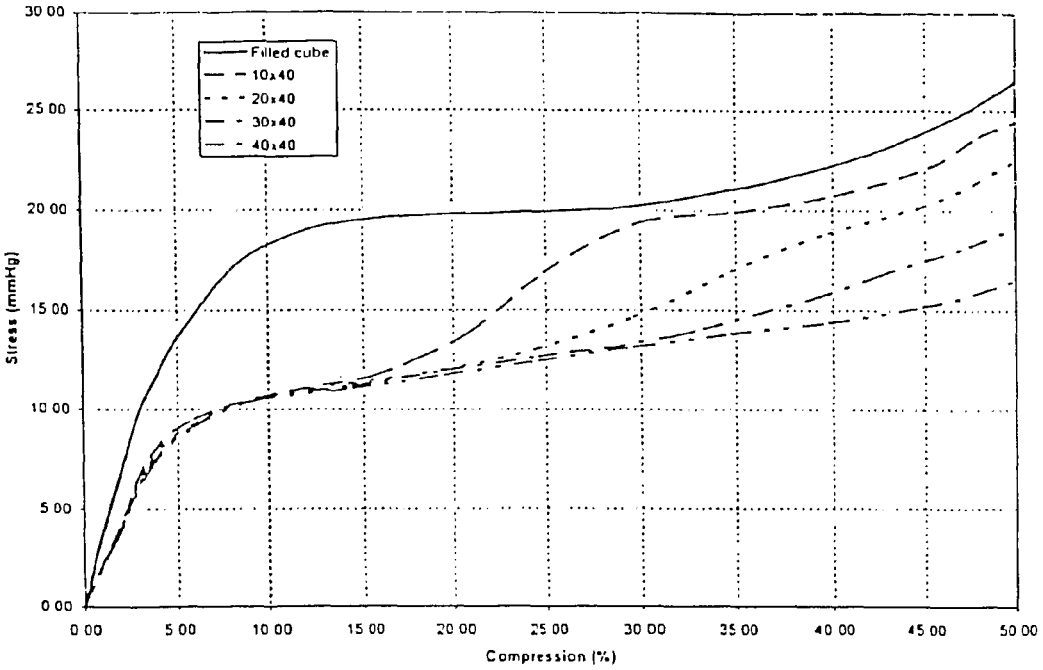
FIG. 4 is a graph illustrating the stress compression curves of various dimensions of foam blocks as a function of % of compression applied from its top surface.

The cavity 22 confers many advantages to the foam blocks 20. Typically, as illustrated on FIG. 4, the compression curve between two planes of a full foam block is divided into three zones. The firmness of the block is elevated at the beginning, is almost absent afterwards, and finally, is increased rapidly when the block of foam 20 is very compressed. The second zone ("zone of constant constraint") allows the mattress 10 to conform to the body. This implies that the body sinks into the mattress 10 thereby increasing his contact surface, without causing any additional pressure exerted on the parts of the body that have already been compressed. The pressure is therefore distributed over the entire body. The cavity 22 enables the modification of the "zone of constant constraint". Thus, it is possible to modulate the levels of constraint to be exerted on the different parts of the body.

For certain cavities 22 (a=10 mm, b=40 mm), there can be two "zones of constant constraint" identified as zones 1 and 2. For example, zone 1 is active when a patient is lying on his/her back and zone 2 is active when the patient is laying on his/her side. This type of cavity 22 would be found at the level of the patient's shoulders.

Another advantage conferred by one realization of the foam block 20 is the wrapping of bony protuberances. Since the cavity 22 is located near the superior portion of the body cushioning pad 12, the internal tension of the foam is reduced. This tension may be adjusted in function of the length of the bottleneck "p" and of the diameter of the bottleneck of the cavity 22. The smaller the length "p" (and/or more the diameter of the bottleneck is large), the less strong is the tension. The top surface 26 of the foam block 20 may also be split. Entry points of different shapes (e.g. crosses, T shapes, L shapes, squares, etc.) can also be used to further vary the tension and the stiffness of the block. An additional layer of a flexible material can be glued to the top of the block to provide broader variation of the block's top surface tension properties.

The foam block 20 also confers the advantage of providing ventilation. The variation of the volume of the sheath produced with the moving of the body on the body cushioning pad 12 generates a displacement of air favouring the oxygenation of the tissues and allowing the elimination of local excess humidity.

Advantageously, the foam block 20 confers firmness for a large compression in the following fashion. Because of the cavity 22, the foam sheath can be soft for small compressions and firm for larger compressions. Thus, the zones necessitating only a small area of distortion (for example, the legs of a human body) will have a cavity which is not very deep in order to avoid sinking (when the patient sits on the mattress to rest or to get up).

Therefore, the body cushioning pad 12 can be calibrated in function of the mass density and in function of the surface contour of the body. More precisely, the body cushioning pad 12 sustains the position of the body and offers the area of distortion necessary to adopt the shapes and protuberances of a patient confined to bed. As such, the body cushioning pad's 12 firmness can be adjusted by surface zone to the pressures exerted upon it by the body.

In use, different parts of a body are respectively in contact with different areas or surface zones of the cushioning pad 12. In accordance with a preferred mode of realization, for each one of the foam blocks 20, the predetermined size and shape of the cavity associated with a specific one of the foam blocks 20 is determined in function of the area where the specific foam block 20 is located in the cushioning pad.

Figure 2A:
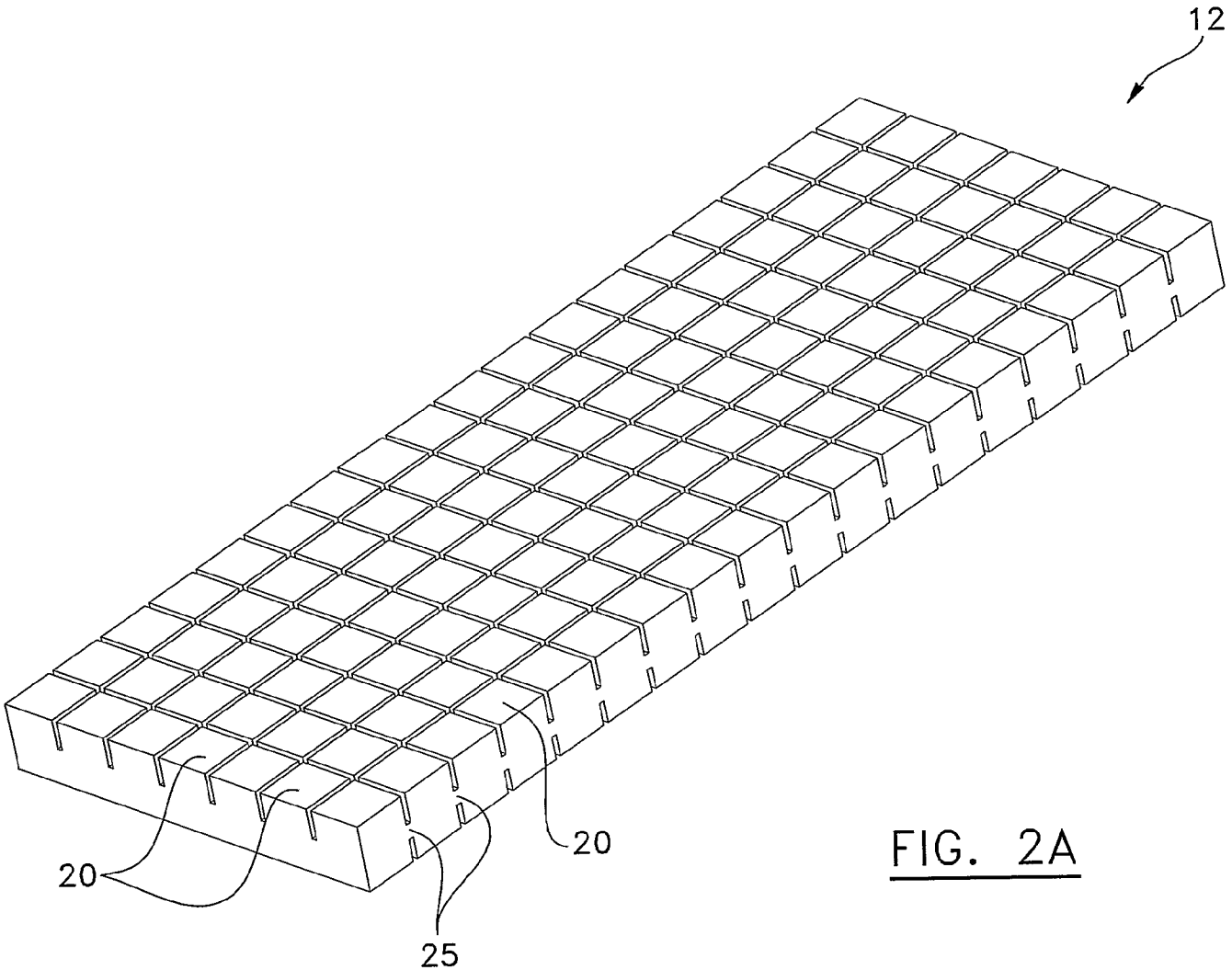
FIG. 2A is a top perspective of a cushioning pad according to another preferred embodiment.
Figure 2B:
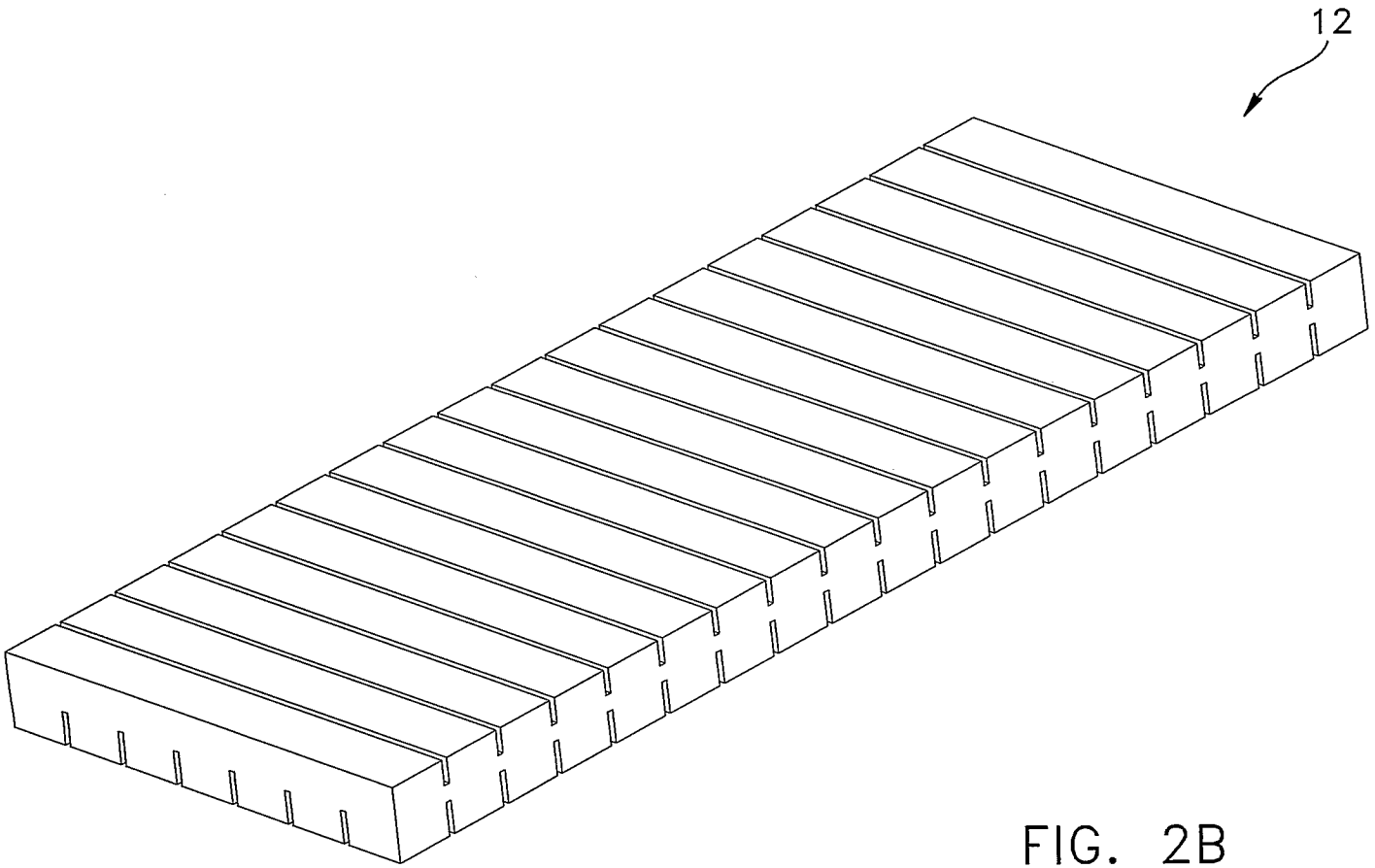
FIG. 2B is a bottom perspective of the cushioning pad of FIG. 2A.
Figure 7A:
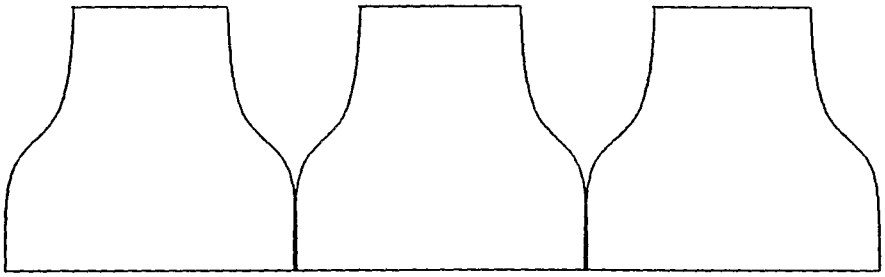
FIGS. 7A and 7B are schematic side views of alternative designs for the foam blocks of the body cushioning pad.
Figure 7B:
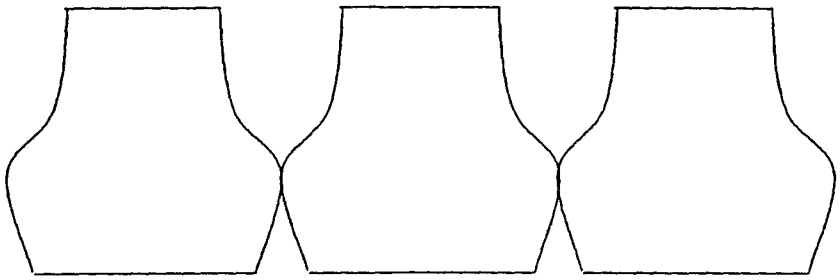

Turning now to FIGS. 2A and 2B, the plurality of foam blocks 20 forming the cushioning pad 12 can also be made starting from single large foam block. Individual blocks and their cavities are obtained using machining techniques. This approach allows for custom made design of the mattress. In such a case, the individual foam blocks are maintained together as a unit by means of web elements 25 interconnecting each adjacent foam blocks 20, the web elements 25 being integral parts of the adjacent foam blocks 20. Alternatively, each block can be manufactured independently and then glued together with an adhesive substance or fasten using a fastener. They could also be glued on a membrane or a thin foam layer. In order to ensure a well defined location of the blocks it is proposed to design the block's shape as suggested in FIGS. 7A and 7B. This variant design of substantially bell shape allows for precise localization of the blocks while allowing their bulging when the blocks are compressed or when the mattress is folded on a raised bed.

Figure 5:
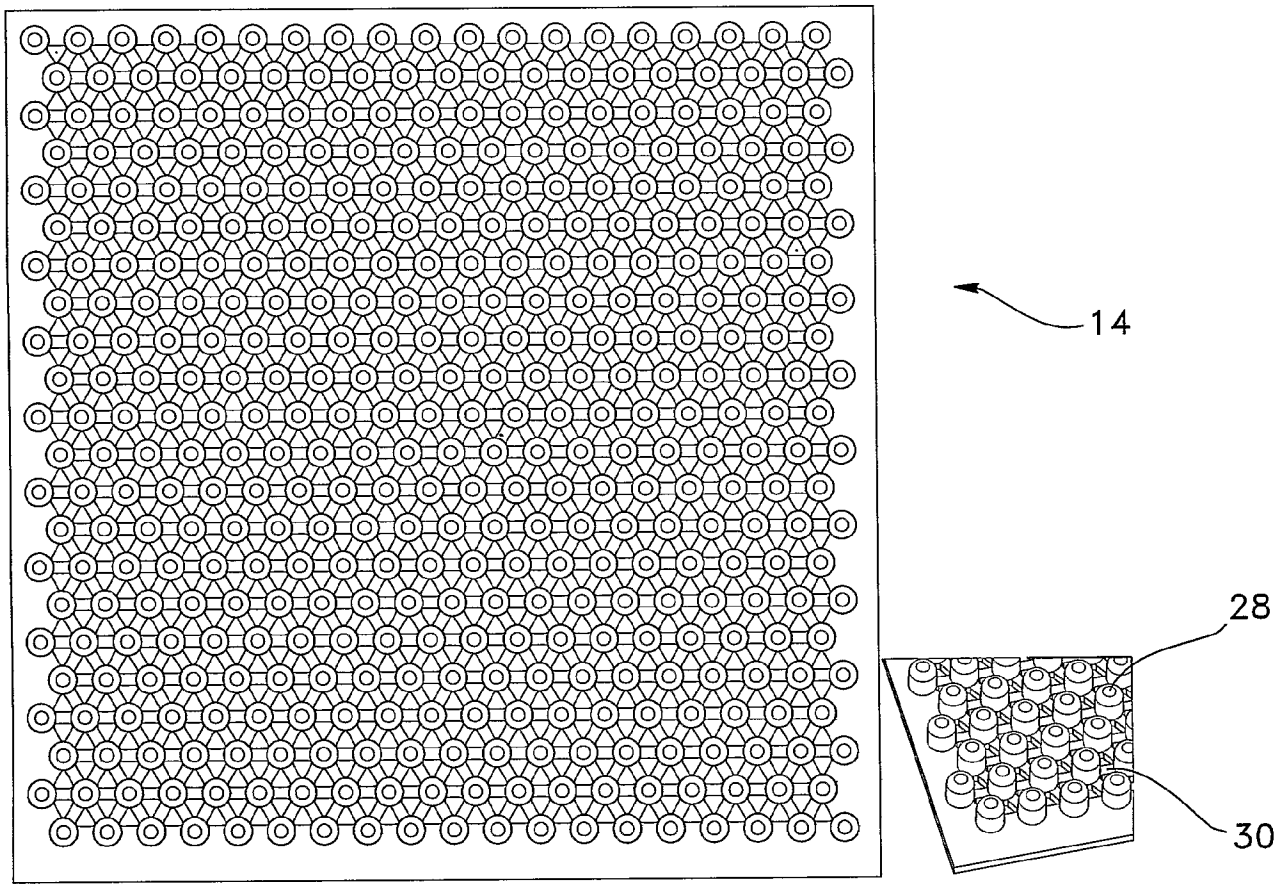
FIG. 5 is a top view of a portion of the body contact mat shown in FIG. 1, a portion of which is shown in perspective.
Figure 6A:
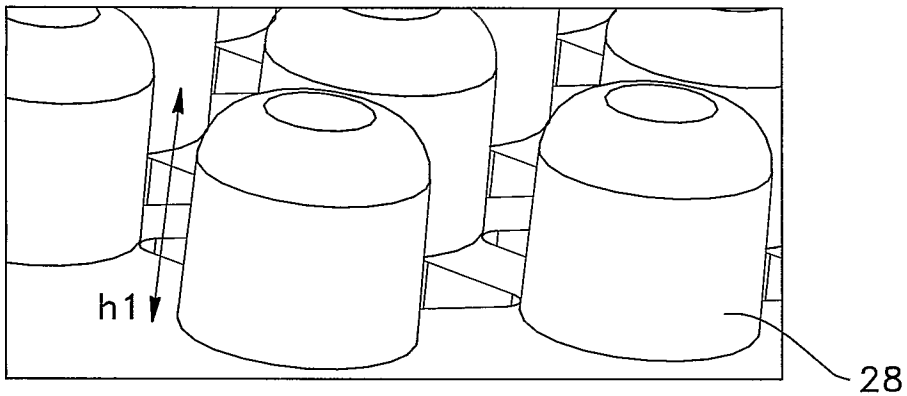
FIG. 6A is an enlarged perspective view of a portion of the contact mat showing studs of height h1.
Figure 6B:
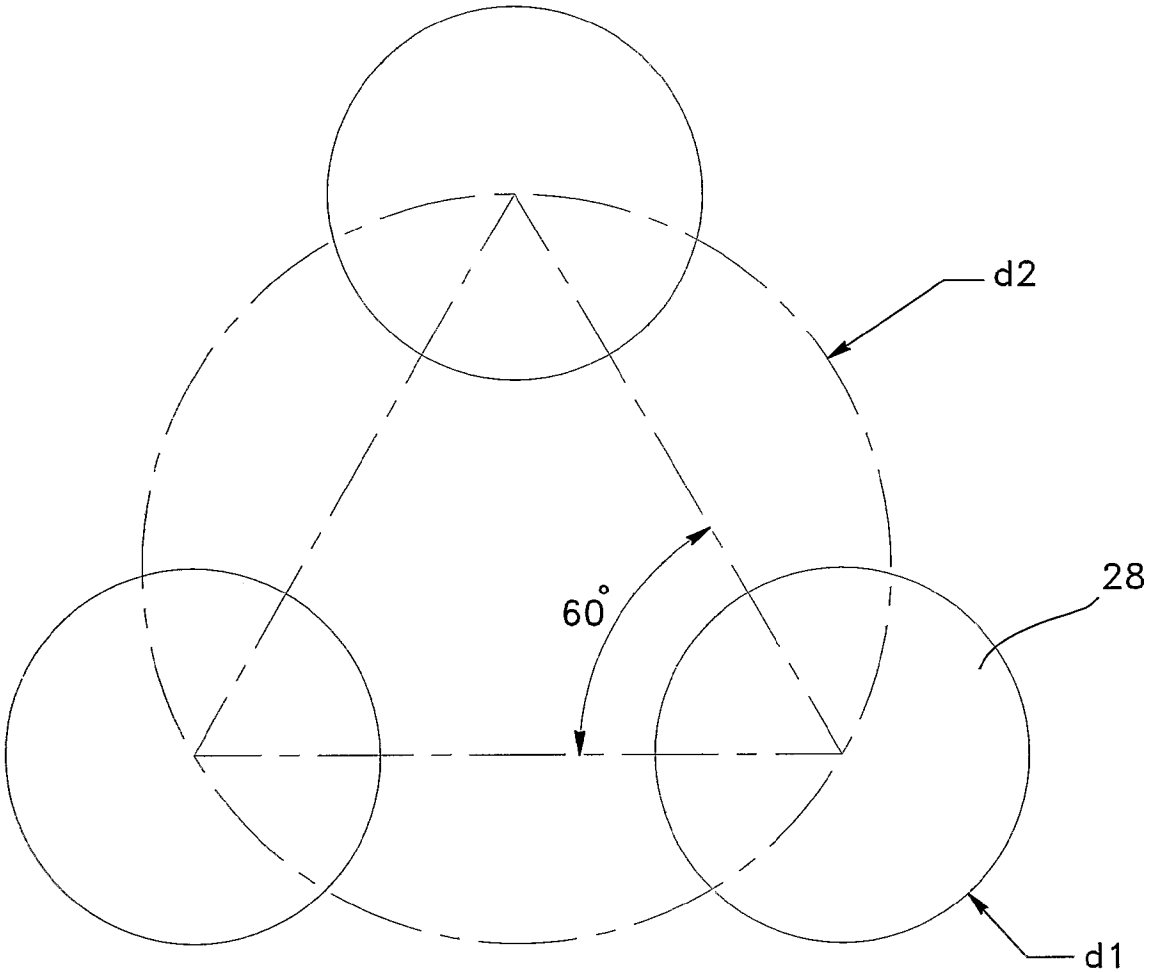
FIG. 6B is an enlarged top view of a portion of the contact mat showing the layout of the three studs.
Figure 8A:
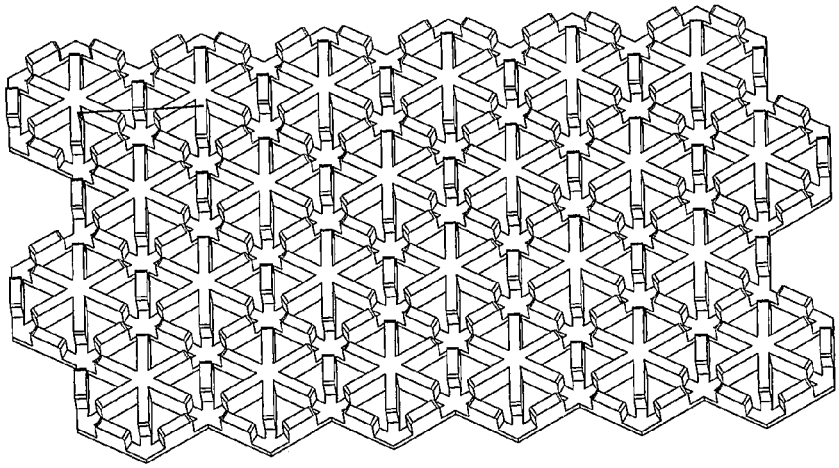
FIGS. 8A and 8B are perspective views of alternative contact mats.
Figure 8B:
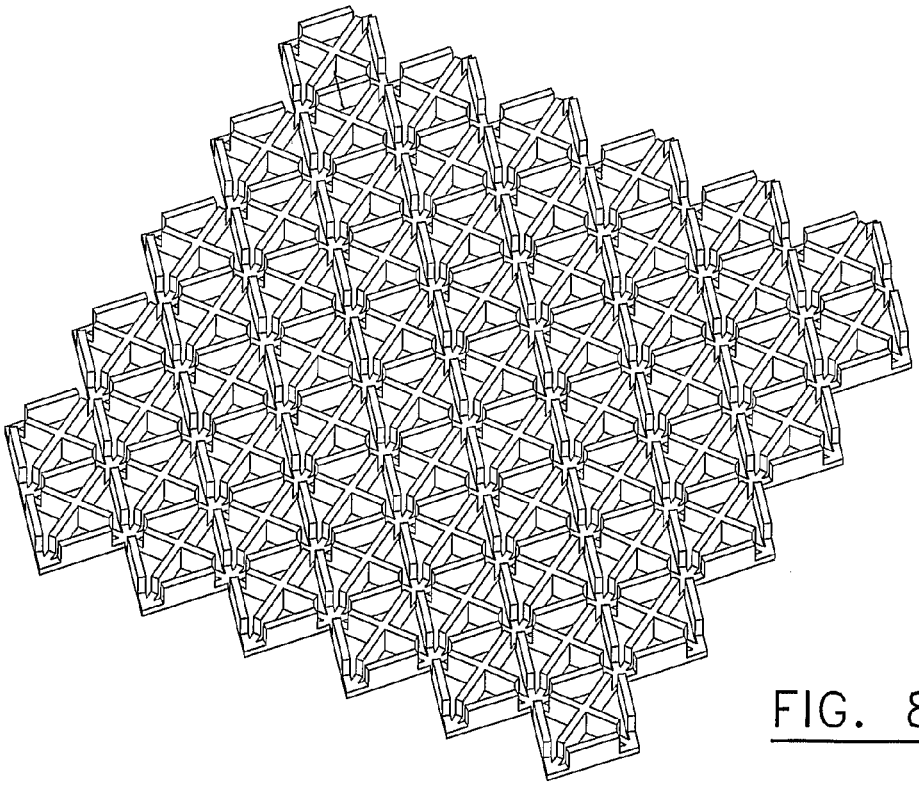

The contact mat 14 modulates the percentage of surface contact between the surface of the body and the mattress assembly 10; and it also ensures ventilation of the mattress assembly 10. As illustrated on FIGS. 5 to 6B, the contact mat 14 comprises studs 28 of height "h1" and of diameter "d1". Together, the studs form a lattice and connect with one another through beams 30. In this regard, d2 is the diameter of the circle or ellipse passing through the center of three studs forming a triangle. Alternatives studs and lattice geometry can be found in FIGS. 8A and 8B.

More specifically, the contact mat 14 allows the distribution of the pressure exerted by the weight of the body on a desired percentage of the surface of the body. Since the surface of the body is only in contact with the studs 28, the blood circulation between the points of contact is facilitated. The distance between the points of contact must be sufficiently small in order to avoid the perception of point of discomfort (sensibility) and sufficiently large for the vascular system of the skin to perceive significant variations in pressure.

The parameters of the typical contact zone are the percentage (%) surface of contact as a function of d1 and d2, sensitivity as a function of d1, and rigidity of the studs 28 as a function of the material used for the studs 28 as well as d1 and h1.

The material used for the studs 28 is typically an elastomeric gel such as TPE gel or silicone. This material must be flexible (typical hardness Shore 00-30) and has a high elongation at rupture ranging from 400%-1200%, more preferably 700%-1000%).

The studs 28 of the contact mat 14 are connected by flexible beam elements or ducts 30. These beams 30 ensure the integrity of the surface of contact albeit without causing or causing little surface tension. In addition, the spaces between the beams ensure the passage of air between the body support pad 12 and the contact mat 14.

The body contact mat 14 bottom surface may be integrated by capillarity during curing to the top surface of the body cushioning pad 12. As for example, if we take the body cushioning pad 12 shown in FIGS. 2A and 2B, the mattress assembly 10 is first cut to proper dimensions, slots are machined both on the top and reverse surfaces, and cavities are machined within each block 20. Then, while the silicone mat is curing, the top surface of the cushioning foam pad 12 is apposed to the bottom surface of the silicone mat 14, such that by capillarity, the liquid silicone gets into the foam cells over a small thickness, thereby mechanically integrating both surfaces together during curing.

Referring again to FIG. 1, the mattress assembly 10 also preferably comprises an anti-friction mat 16 which is positioned between the cushioning pad 12 and the contact mat 14. It is composed of two (2) materials of the "lycra" type in order to ensure slipping between the contact mat 14 and the body cushioning pad 12 to eliminate any surface tension between the layers.

For illustration purposes only, one mode of realization of the foam block could have the following characteristics.

Body support surface: foam blocks of about 4 inch for each edge, 5.5 inch height, machined within a foam pad of 5.5 inch thick, made of high resilience foam of 2.4 to 2.7 lb of density. Internal canal connecting cavity to surface: circular hole of 1 inch diameter. Cavities are ellipsoidal with 25 mm (vertical radius)×40 mm radius for all blocks (18 lanes by 7 rows) except those on lanes 3 and 4 and 7, 8, 9 and 10 for a standard mattress, i.e. areas where the hips and shoulders lie. For these areas, cavities are ellipsoidal with 40 mm (vertical)×35 mm radius. Mattress foam block assembly length is 77.25 inches by 29.81 inches, around which bumpers are added. The laterals bumpers are 2.63 inches thick, the toe bumper is 1 inch and the head bumper range from 0 inch to 5.75 inches to accommodate mattress length from 78 to 84 inches.

In addition, although the preferred embodiment of the present invention illustrated in the accompanying drawings comprises specific components and geometrical configurations, not all of these components and geometries are essential to the invention and should thus not be taken in their restrictive sense. In other words, they should not be taken as to limit the scope of the present invention. As will be apparent to any one skilled in the art, other suitable components as well as other suitable geometrical configurations could be used for the cover and its corresponding parts according to the present invention.

What is claimed is:

1. A multi-layered cushioning structure comprising:

a cushioning pad, comprising:

an array of a plurality of foam blocks, each defining a plurality of external surfaces thereof and each being provided with an internal closed cavity having a predetermined size and shape chosen to control the firmness of the block, each said internal closed cavity being spaced from the plurality of external surfaces including a top surface of corresponding said plurality of foam blocks; and means for maintaining said plurality of foam blocks as a unit so as to form the cushioning pad;

a body contact mat topping the body cushioning pad and including a bi-dimensional latticed structure of spaced-apart studs made of an elastomeric gel material and linked together by flexible linking elements, a bottom surface of the body contact mat being integrated into the top surface of each said foam blocks of the cushioning pad, the body contact mat defining through holes extending between adjacent said flexible linking elements to ensure passage of air to the cushioning pad.

2. The multi-layered cushioning structure as defined in claim 1, further comprising a wrapper to wrap the cushioning pad and the contact mat together.

3. The multi-layered cushioning structure as defined in claim 1, wherein, for each foam block, the volume of said cavity represents 3 to 30% of the total volume of the foam block.

4. The multi-layered cushioning structure as defined in claim 1, wherein the elastomeric gel material has an elongation at rupture in a range of at least 400% to 1200%.

5. The multi-layered cushioning structure as defined in claim 1, wherein the density of the foam block is from at least 1 lbs/ft3 to 3 lbs/ft3.

6. The multi-layered cushioning structure as defined in claim 1, wherein the elastomeric gel material is TPE gel or silicone.

7. The multi-layered cushioning structure as defined in claim 1, wherein the flexible linking elements are tubular elements.

8. The multi-layered cushioning structure as defined in claim 1, wherein the internal cavity in each of said plurality of foam blocks is located in an upper portion thereof.

9. The multi-layered cushioning structure as defined in claim 1, wherein, for each foam block, the volume of said cavity represents at least 3% of the total volume of the foam block.

10. The multi-layered cushioning structure as defined in claim 9, wherein each of said foam block comprises an internal canal connecting the internal cavity to the top surface of the foam block.

11. The multi-layered cushioning structure as defined in claim 1, wherein the foam blocks are parallelepiped-shaped or bell-shaped.

12. The multi-layered cushioning structure as defined in claim 1, wherein the predetermined shape of each said internal closed cavity is an ellipsoidal shape, a polyhedral shape or a spherical shape.

13. A multi-layered cushioning structure comprising:

a cushioning pad, comprising:

an array of a plurality of foam blocks, each defining a plurality of external surfaces thereof and each being provided with an internal closed cavity having a predetermined size and shape chosen to control the firmness of the block, each said internal closed cavity being spaced from the plurality of external surfaces including a top surface of corresponding said plurality of foam blocks; and means for maintaining said plurality of foam blocks as a unit so as to form the cushioning pad;

a body contact mat topping the body cushioning pad and including a bi-dimensional latticed structure of spaced-apart studs made of an elastomeric gel material and linked together by flexible linking elements, a bottom surface of the body contact mat being integrated by capillarity into the top surface of each said foam blocks of the cushioning pad.

* * * * *